US005413150A

United States Patent [19]

Townsend

[11] Patent Number: 5,413,150

[45] Date of Patent: May 9, 1995

[54] FRAME WITH CLIP TYPE YARN HOLDER

[76] Inventor: Irving Townsend, 11910 Mayfield #303, Los Angeles, Calif. 90049

[21] Appl. No.: 188,804

[22] Filed: Jan. 31, 1994

[51] Int. Cl.[6] ..... D03D 29/00

[52] U.S. Cl. ..... 139/34; 24/563; 28/152; 66/4

[58] Field of Search ..... 28/151, 152, 149; 66/1 A, 4; 139/34; 24/563, 543, 570

[56] References Cited

U.S. PATENT DOCUMENTS

| | | | |
|---|---|---|---|
| 3,473,097 | 10/1969 | Barnett | 139/34 |
| 3,769,667 | 11/1973 | Cooper | 28/152 |
| 4,246,768 | 1/1981 | Palange | 66/4 |
| 4,881,381 | 11/1989 | Townsend | 28/149 |

*Primary Examiner*—Andrew M. Falik
*Attorney, Agent, or Firm*—Albert O. Cota

[57] ABSTRACT

A frame (20) having a number of yarn holding clips (30) attached on an outside edge for looping yarn in a first direction around adjacent parallel clips to form a warp. A second number of opposed clips likewise mounted on the frame, permit a second looping yarn to be layered on top in a woof-like manner. The frame (20) has parallel sides and is preferably square or rectangular in shape. The clips (30) have legs (32), (34) and (36) that mate with the frame and an upstanding leg (38) provides the attachment point for the yarn. The clips are attached by nails (42) in the preferred embodiment or by spring tension in a third embodiment. A second embodiment provides a narrower upstanding leg (38) to pre-space the leg when the clips are touching each other. In a fourth embodiment, a frame having a multiplicity of rectangular frame cavities (50) is used. Into these cavities is inserted a yarn holding clip (30).

20 Claims, 2 Drawing Sheets

FRAME WITH CLIP TYPE YARN HOLDER

TECHNICAL FIELD

The invention pertains to the general field of frames and more particularly to frames having clips for holding yarn during weaving and crocheting to make a textile fabric.

BACKGROUND ART

Previously, many types of devices have been used in endeavoring to provide an effective means for producing a structural frame that holds yarn in a predetermined spaced relationship for weaving fabric. The conventional method of weaving employs a frame with pins or pegs spaced apart on two parallel edges with yarn or thread stretched inbetween forming a warp A woof is added with yarn interwoven in an opposite manner. While this method is used for conventional materials, the invention is directed specifically to an application wherein a textile is manufactured in a different process stretching yarn between pegs forming a warp layer and a second layer 90-degrees from the first is laid directly on top but not interlaced. The yarn is then crocheted in a chain stretch to hold the fabric together. So recently patented, this method of producing a new and unique textile fabric is shown in FIG. 7 and is disclosed in the applicant's U.S. Pat. No. 4,881,381 which issued on Nov. 24, 1989. The problem that presently exists deals with the frame originally employed in this method of fabric construction that was well known in the art and consisted of a rectangular, oval, polygoned, square or round frame of wood, thermoplastic, composition board or the like. This frame utilized pins or pegs in the form of wood dowels or nails penetrating the frame to which the yarn was wrapped. These pegs, in order to be held by the frame, required location upward from the inside edge a sufficient distance to permit their attachment in order to have the structural integrity required. In a typical frame, the pegs would be positioned substantially ¼ inch (0.64 mm) in from the edge. The weaving process utilizing the pegs caused some problems: first, since the yarn extends over the frame when wound, it is difficult to get the crotchet hook through the wound yarn because the wood gets in the way. Second, because the yarn has to travel around the pegs, loops remain on all four sides of the woven material when the material is removed from the frame.

This present invention is directed to solve these problem with the prior art and provide an upstanding structural leg that is even with the top of the frame and flush with the inside edge. This improvement eliminates the loops in the yarn previously created by the pegs inboard location and facilitates the final crocheting around the perimeter of the fabric in a neat and orderly manner. Additionally, in the new design, the clips may be moved or clips added to allow a closer or looser weave. Also, the detachable holding clips are economical and allow the weaving to be completed at a faster rate.

DISCLOSURE OF THE INVENTION

Since the problem existed on a specialized frame for making a textile fabric, the primary object of the invention is the elimination of the loops as previously discussed, which also prevents unraveling of the yarn at the edge and actually speeds up the process of making the fabric.

An important object of the invention is the adjustability of the yarn holding clips which are easier and quicker to assemble to the frame then nails or pegs and may be adjusted for spacing which changes the texture of the fabric. In a second embodiment, the upstanding leg of the clip is narrower than the balance of the clips permitting the spacing to be predetermined which eliminates the need for measuring. Further, the clip may be any width which is directly proportional to the woof and warp spacing.

Another object of the invention is the ability to fasten the clip to the frame with a nail once the spacing is established and the frame is to be used for the particular pattern a number of times.

still another object of the invention is directed to a third embodiment in which the clips are made of spring steel and have a right angle upwardly depending finger on the lower leg. The lower leg of the clip is expanded sufficiently to slip over the frame and is held in place by the tension of the material and the fact that the clip is contiguous with all four sides of the frame.

In a fourth embodiment, the frame is made with a rectangular frame cavities that are located around the frame near its upper, inside edge. Into each of these cavities is selectively inserted a holding clip that includes a lower, vertical leg sized to be inserted and frictionally held within a cavity. From the top of the vertical leg extends a horizontal stabilizing section that from its inward end there is an upstanding leg that holds the yarn.

Yet another object of the invention is realized when the finished textile fabric is made in a square or rectangular shape and fastened together by crocheting to form a large finished piece as the edges are now even and flush when utilizing the invention's improved clips positioned on the periphery of the frame.

These and other objects and advantages of the present invention will become apparent from the subsequent detailed description of the preferred and other embodiments also the appended claims, further, taken in conjunction with the accompanying drawings.

BEST MODE FOR CARRYING OUT THE INVENTION

The best mode for carrying out the invention is presented in terms of four embodiments. All four embodiments perform the same function and all four utilizes a yarn holding clip. In the fourth embodiment, a frame and clip that differs from the first three embodiments are disclosed.

Figure 1:
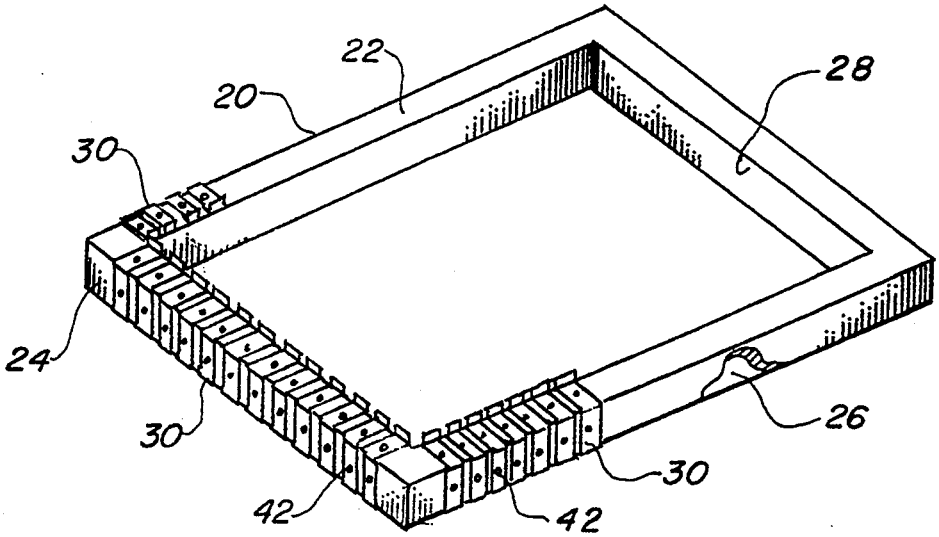
FIG. 1 is a partial isometric view of the preferred embodiment.

The frame 20 is preferably four sided in the shape of a rectangle with parallel sides as illustrated in FIG. 1 or square with each side having an equal length. While this configuration is preferred, any shape may be utilized with comparable ease such as round, oval polygonal etc. The frame 20 is structurally rigid and each side contains a top 22, an outside edge 24, a bottom 26 and an inside edge 28.

Figure 2:
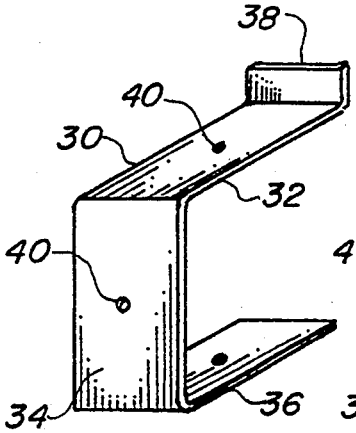
FIG. 2 is a partial isometric view of the clip in the preferred embodiment.

Positioned around the frame 20 are a number of holding clips 30 best illustrated in FIG. 1. The clips 20 are attached to the frame and are equally spaced either contiguous with each other or apart a predetermined distance. As shown in FIG. 2, each clip 30 has an upper leg 32 contiguous with the frame top 22, an outside leg 34 contiguous with the frame outside edge 24, a lower leg 36 contiguous with the frame bottom 26 and a freely upstanding leg 38 parallel with the frame inside edge 28.

The clips 30 are positioned on the frame 20 oppositely allowing a strand of yarn to be looped over each upstanding leg 38 and wound a first direction around each adjacent parallel clip 30 to form a warp and then a second direction 90-degrees from the first around each remaining clip 30 forming a woof-like layer on the top. The two layers are then joined together by a crocheted chain strip while still in the frame 20.

Each clip 30 may have a width of from $\frac{1}{8}$ inch (3.17 mm) to $\frac{3}{8}$ inch (9.5 mm) and are spaced apart on the frame 20 from $\frac{1}{8}$ inch (3.17 mm) to 1 inch (25.4 mm), The clip 30 is preferably made of a formable metal or injection molded of a thermoplastic material and is sized to form a friction fit when positioned over the frame 20 as it is in a C-shape and is capable of a tight fit between the upper leg 32 and the lower leg 36.

For permanent attachment, a single or a number of holes 40 are positioned within the legs contiguous with the frame 20 to which a nail 42 may be inserted. When the frame is made of wood or composition board, this attachment means is ideal or if the frame is made of metal, thermoplastic or the like, the friction fit would be more appropriate.

Figure 3:
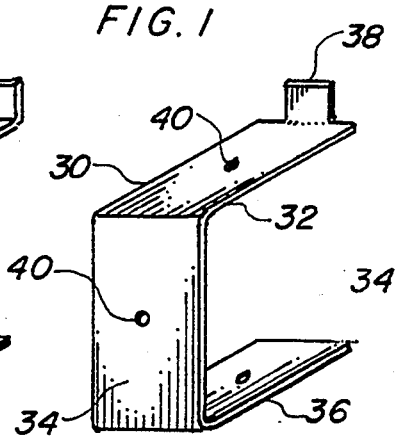
FIG. 3 is a partial isometric view of the clip in the second embodiment.

In the preferred embodiment, the upstanding leg 38 of the clip 30 is the same width as the remaining legs however, in the second embodiment the upstanding leg 38 is narrower as illustrated in FIG. 3. This difference permits a specific distance between the legs 38 when the balance of the clip 20 are touching one another eliminating any measuring when the clips are initially installed.

Figure 4:
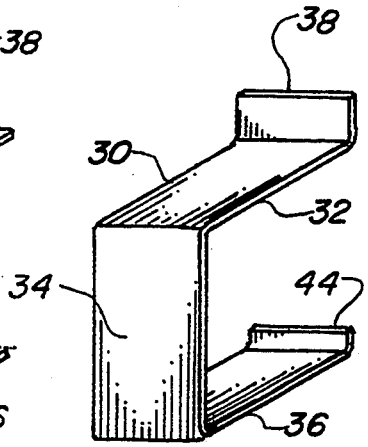
FIG. 4 is a partial isometric view of the clip in the third embodiment.

The third embodiment of the clip 30 is depicted in FIG. 4 and is basically the same as the preferred and second embodiment except a upwardly depending finger 44 is extended from the lower leg 36. This finger 44 extends upward only a short distance permitting the lower leg 36 to be bent downward and slid over the frame 20 until it snaps into place on the inside edge 28 of the frame. The clip 30 in this embodiment is therefore made of spring steel to facilitate this functional positioning. The friction fit of the entire clip in a snap-on fashion eliminates the holes 40 and nails 42 add is particularly useful in the metallic frame construction.

Figure 5:
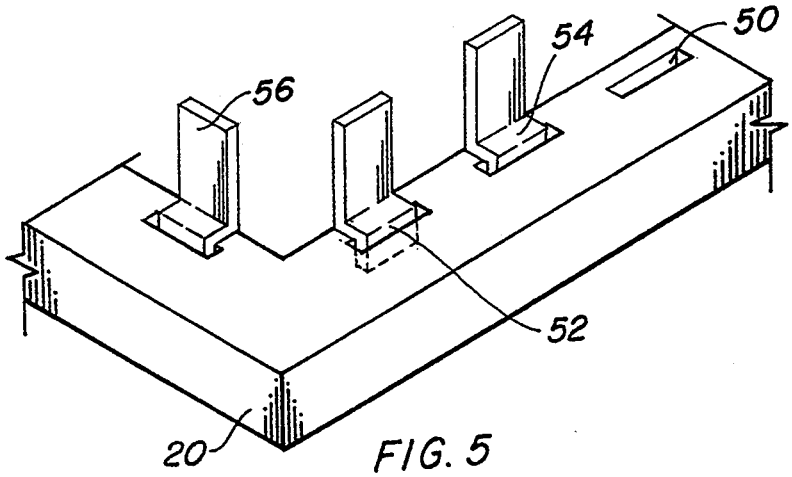
FIG. 5 is a partial isometric view of the frame used with the fourth embodiment.
Figure 6:
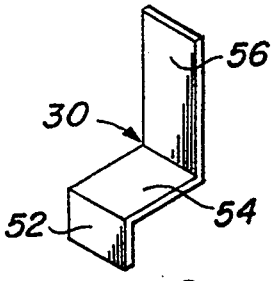
FIG. 6 is a partial isometric view of the clip in the fourth embodiment.
Figure 7:
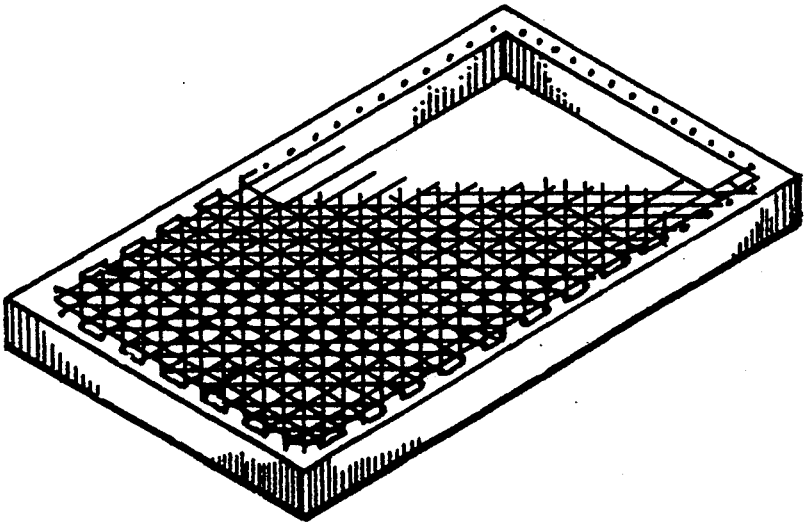
FIG. 7 PRIOR ART
FIG. 7 is a partial isometric view of the prior art frame having pins and the yarn illustrated over the pins in a fragmentary section.

The fourth embodiment utilizes a frame 20 that includes around its upper, inside edge, a multiplicity of spaced rectangular, frame cavities 50 as shown in FIG. 5. Into each cavity is selectively inserted a yarn holding clip 30. As shown in FIG. 6, the clip 30 consists of a lower, vertical leg 52 that is sized to be inserted and frictionally held within a frame cavity 50. From the top of the leg 52, contiguously extends a horizontal stabilizing section 54 that from its inward end there is contiguously located an upstanding leg 56. The leg 56, performs the same function as the upstanding leg 38 as described for the prior embodiments.

While the invention has been described in complete detail and pictorially shown in the accompanying drawings it is not to be limited to such details, since many changes and modification may be made in the invention without departing from the spirit and scope thereof. Hence, it is described to cover any and all modifications and forms which may come within the language and scope of the appended claims.

I claim:

1. A frame device with yarn holders for retaining yarn during a weaving and crocheting process to make a textile fabric, the frame and holders comprising:

a) a multi-sided rigid structural frame, each side having a top, an outside edge, a bottom and an inside edge, and b) a plurality of yarn holding clips attached to the frame, each clip having an upper leg contiguous with the frame top, an outside leg contiguous with the frame outside edge, a lower leg contiguous with the frame bottom and a freely upstanding leg parallel with the frame inside edge, said clips disposed on each of the sides of the frame in opposed relationship such that a strand of yarn may be looped over each upstanding leg and wound in a first direction around each adjacent parallel clip to form a warp and a second direction 90-degrees from the first around each of the remaining adjacent parallel clips to form a woof-like layer on top of the warp.

2. The frame as recited in claim 1 wherein said frame is rectangular in shape having parallel sides.

3. The frame as recited in claim 1 wherein said frame is square in shape with each side a equal length.

4. The frame as recited in claim 1 wherein said frame having a multiplicity of rectangular frame cavities located around the upper, inside edge of said frame.

5. The frame as recited in claim 1 wherein said clip further comprises a width of from $\frac{1}{8}$ inch (3.17 mm) to $\frac{3}{8}$ inch (9.5 mm).

6. The frame as recited in claim 1 wherein said clips are spaced apart on the frame from $\frac{1}{8}$ inch (3.17 mm) to 1 inch (25.4 mm).

7. The frame as recited in claim 1 wherein said clip upstanding leg is the same width as the remaining legs.

8. The frame as recited in claim 1 wherein said clip upstanding leg is narrower than the remaining legs so as to pre-space a distance between upstanding legs when the remaining legs are contiguous with each other.

9. The frame as recited in claim 1 wherein said clip is made of a formable metal.

10. The frame holder as recited in claim 1 wherein said clip is formed of a thermoplastic material.

11. The frame as recited in claim 1 wherein said clip is sized to form a friction fit to the frame when disposed thereon.

12. The frame as recited in claim 1 wherein said clip has at least one hole therein permitting a nail to be utilized for attaching the clip to the frame.

13. A yarn holder for retaining yarn during a weaving and crocheting process to make a textile fabric, the holder comprising:

a) a multi-sided rigid structural frame, each side having a top, an outside edge, a bottom and an inside edge, and b) a plurality of yarn holding clips attached to the frame, each clip having an upper leg contiguous with the frame top, an outside leg contiguous with the frame outside edge, a lower leg formed with a right angle upwardly depending finger, the lower leg contiguous with the frame bottom and the finger grasping a lower portion of the frame inside edge and a freely upstanding leg parallel with the frame inside edge, said clips disposed on each of the four sides of the frame in opposed relationship such that a strand of yard may be looped over each upstanding leg and wound a first direction around each adjacent parallel clip to form a warp and a second direction 90-degrees from the first around each of the remaining adjacent parallel clips to form a woof-like layer on top of the warp.

14. The yarn holder as recited in claim 13 wherein said frame is rectangular in shape having parallel sides.

15. The yarn holder as recited in claim 13 wherein said frame is square in shape with each side a equal length.

16. The yarn holder as recited in claim 13 wherein said clip further comprises a width of from $\frac{1}{8}$ inch (3.17 mm) to $\frac{3}{8}$ inch (9.5 mm).

17. The yarn holder as recited in claim 13 wherein said clips are spaced apart on the frame from $\frac{1}{8}$ inch (3.17 mm) to 1 inch (25.4 mm).

18. The yarn holder as recited in claim 13 wherein said clip upstanding leg is the same width as the remaining legs.

19. The yarn holder as recited in claim 13 wherein said clip upstanding leg is narrower than the remaining legs so as to pre-space a distance between upstanding legs when the remaining legs are contiguous with each other.

20. The yarn holder as recited in claim 19 wherein said clip is sized to form a snap on friction fit to the frame when disposed thereon.

* * * * *